US011781261B2

(12) United States Patent
Bover Capdevila et al.

(10) Patent No.: US 11,781,261 B2
(45) Date of Patent: Oct. 10, 2023

(54) WASHING AND/OR DRYING MACHINE WITH STATUS INDICATION AND CONTROL SYSTEM OF A SET OF WASHING AND/OR DRYING MACHINES

(71) Applicant: GIRBAU SA, Vic (ES)

(72) Inventors: Eudald Bover Capdevila, Vic (ES); Òscar Bach Vilà, Santa Eulàlia de Riuprimer (ES)

( * ) Notice: Subject to any disclaimer, the term of this patent is extended or adjusted under 35 U.S.C. 154(b) by 330 days.

(21) Appl. No.: 17/023,083

(22) Filed: Sep. 16, 2020

(65) Prior Publication Data

US 2021/0079579 A1 Mar. 18, 2021

(51) Int. Cl.

| | |
|---|---|
| ***D06F 34/34*** | (2020.01) |
| ***D06F 37/26*** | (2006.01) |
| ***D06F 58/04*** | (2006.01) |
| ***D06F 105/58*** | (2020.01) |

(52) U.S. Cl.
CPC ..... *D06F 34/34* (2020.02); *D06F 37/26* (2013.01); *D06F 58/04* (2013.01); *D06F 2105/58* (2020.02)

(58) Field of Classification Search
CPC ..... D06F 34/34; D06F 37/26; D06F 58/04; D06F 2105/58
USPC ..... 34/596
See application file for complete search history.

(56) References Cited

U.S. PATENT DOCUMENTS 3,155,462 A * 11/1964 Erickson ..... D06F 58/04 55/357
5,906,056 A * 5/1999 Noguchi ..... D06F 37/225 34/602
8,178,802 B2 * 5/2012 Roose ..... D06F 34/34 200/296
9,220,394 B2 * 12/2015 Heater ..... F21V 33/0044
10,954,619 B2 * 3/2021 De Pellegrin ..... D06F 34/34
10,988,895 B2 * 4/2021 Kim ..... D06F 58/04
11,359,329 B2 * 6/2022 Yu ..... D06F 58/206
11,441,256 B2 * 9/2022 Lee ..... D06F 58/20
2007/0151311 A1 * 7/2007 McAllister ..... D06F 39/088 68/3 R
2021/0079579 A1 * 3/2021 Bover Capdevila .... D06F 34/34

FOREIGN PATENT DOCUMENTS

EP 2604740 A1 * 6/2013 ..... D06F 37/26
JP 2011200523 A * 10/2011
KR 2010096548 A * 9/2010

* cited by examiner

*Primary Examiner* — Stephen M Gravini

(74) *Attorney, Agent, or Firm* — Eugenio J. Torres-Oyola; Rafael Rodriguez-Muriel; Victor M. Rodriguez-Reyes

(57) ABSTRACT

The present invention relates to a washing and/or drying machine with status indication and a control system for controlling a group of washing and/or drying machines, said fabric washing and/or drying machine comprising a casing (10) defining a front panel (11), an upper panel (12), two side panels (13), and a rear panel, and containing a compartment (15) for treating fabrics accessible through an opening of the casing provided with a door (16); and a light emitting element (20) protected by a cover (25) transparent or translucent to light, closing an opening of said panel, said light emitting element (20) being configured for emitting light indicative of an operating status of the machine to the outside of the casing (10), said cover being integrated at least in the front panel (11).

6 Claims, 2 Drawing Sheets

WASHING AND/OR DRYING MACHINE WITH STATUS INDICATION AND CONTROL SYSTEM OF A SET OF WASHING AND/OR DRYING MACHINES

FIELD OF THE ART

The present invention relates to the sector of industrial washing machines, particularly for treating fabrics by means of washing and/or drying, and is applicable in self-service laundromats, public washing centers, hotel laundromats, and the like, in which a plurality of washing and/or drying machines is made available to the users or employees of the center.

The invention proposes providing very effective visual information about the operating status of the machine, particularly about washing or drying cycles, in a highly effective manner and without including elements which substantially alter or increase the effective volume of the machine.

STATE OF THE ART

Washing machines containing light emitting devices for indicating different operating incidents of the machine are known in the state of the art.

Document GB693045 discloses washing machines and machines of another type having a system formed by lighting devices individually controlled by control cards, such that they emit light synchronized with the different operations of the machine that is required.

Document EP1332708 discloses a home appliance, such as a dishwasher or a refrigerator, which is provided with a light emitting device and an optical fiber cable transporting light information from an external device. This light emitting device can vary chromatically depending on the commands received from a program sequence control unit of the home appliance. Through one of its depictions in the form of a drawing, the mentioned document discloses that the light emitting device is integrated in the home appliance, emitting visible light from the front and side views of the home appliance, said device furthermore being the end part of an optical fiber cable which receives light information from another lighting device outside the home appliance and connected thereto.

However, the light emitting device integrated in the home appliance disclosed in the preceding document does not allow viewing it from an aerial view thereof, and neither does it allow light combination, with the emitted light varying in intensity and within a wide range of colors depending on the commands received by the control unit synchronized with the different processes of the appliance being tracked.

There is therefore a need for washing and/or drying machines comprising a light emitting device which is integrated in the machine and arranged flush with same, such that it allows placing several machines in rows and such that the light emitting device can vary light intensity and/or color, within a wide range of colors, where a specific color or shade can be assigned to the different process statuses of the machine, and such that the lighting device is controlled by a control unit synchronized with the parameters being tracked, and such that said light emitting device is visible from the different front, side, and aerial views, simultaneously.

BRIEF DESCRIPTION OF THE INVENTION

To that end, the present invention proposes a washing and/or drying machine for textiles comprising a lighting device which is programmed and synchronized with a chosen series of statuses and/or processes of the washing and/or drying machine and which is visible from aerial and front views, facilitating easy and direct recognition of said statuses and/or processes by a user.

Alternatively, it has been envisaged that several machines, particularly machines available in a laundromat, indicate said status by means of a common signaling (color, color gradation, intermittency, or a combination thereof), thereby facilitating quick localization by the users.

As disclosed, for example, in document GB693045, there are known in the art washing and/or drying machines comprising a casing defined by a front panel, an upper panel, two side panels, and a rear panel with a compartment in which textiles are treated, said compartment being accessible through an opening of the casing provided with a door. The mentioned washing and/or drying machine further comprises, integrated in the front panel, a light emitting element, such as, for example, one or more light bulbs, which are connected to an electronic control board and configured for emitting light indicative of a particular operating status of the machine to the outside of the casing, i.e., said light bulbs turn on and off according to a prior configuration and informing of a particular operating status of the machine.

Unlike the washing and/or drying machines known in the state of the art, the present invention comprises a light emitting element protected by a cover, which is integrated in the upper panel and configured so that the light emitted by said light emitting element is visible from a front face, a side face, and from the upper part, i.e., according to an aerial view in any position around the machine, such that a person who is taller than the machine would be able to see the emitted light as well as a camera located at a higher point with respect to the machine. In one embodiment, the mentioned cover has a first portion which is part of the upper panel, a second portion corresponding with the side, and a third portion integrated in the front panel.

The mentioned cover, generally transparent or translucent, may be flush with the upper panel and/or with the front and side panels, and preferably comprises a single element, i.e., the transparent or translucent covers that are flush with the three panels can be a single continuous element.

Another feature of the proposed lighting device and cover is that it is integrated in a corner of the machine with it hardly protruding from the side and upper walls thereof, so it does not entail a drawback for packaging the machine for transport.

In one embodiment, the light emitting element is formed by an RGB LED emitter, i.e., a (Red, Green, and Blue) light emitting diode, connected to an electronic control board, such that said electronic control board allows providing by means of said RGB LED a wide range of colors, color gradations, intermittencies with different frequencies and different intensities, or a combination thereof. Said wide range of colors and intensities may be synchronized with the different operating cycles of the washing and/or drying machine being considered, such that a large number of operating cycles of the washing and/or drying machine can be identified with the different colors, color gradations, and/or intermittencies of different frequencies emitted by the light emitting element.

The proposed solution in combination with one or more cameras allows constituting a centralized control or monitoring system for a self-service laundromat, industrial laundromat, or hotel laundromat, or work center, making it possible to record any incident and keep a record of the activity of the different washing machines of a specific establishment, by means of remote control.

Other features of the invention will become apparent in the following detailed description of an embodiment.

BRIEF DESCRIPTION OF THE DRAWINGS

The foregoing and other advantages and features will be better understood based on the following detailed description of an embodiment in reference to the attached drawing which must be interpreted in an illustrative and non-limiting manner, in which.

DETAILED DESCRIPTION OF AN EMBODIMENT

The attached drawings show illustrative non-limiting embodiments of the present invention.

It will be understood that the different parts making up the invention described in one embodiment can be freely combined with parts described in other different embodiments even though said combination has not been explicitly described, provided that the combination does not entail any drawback.

Figure 1:
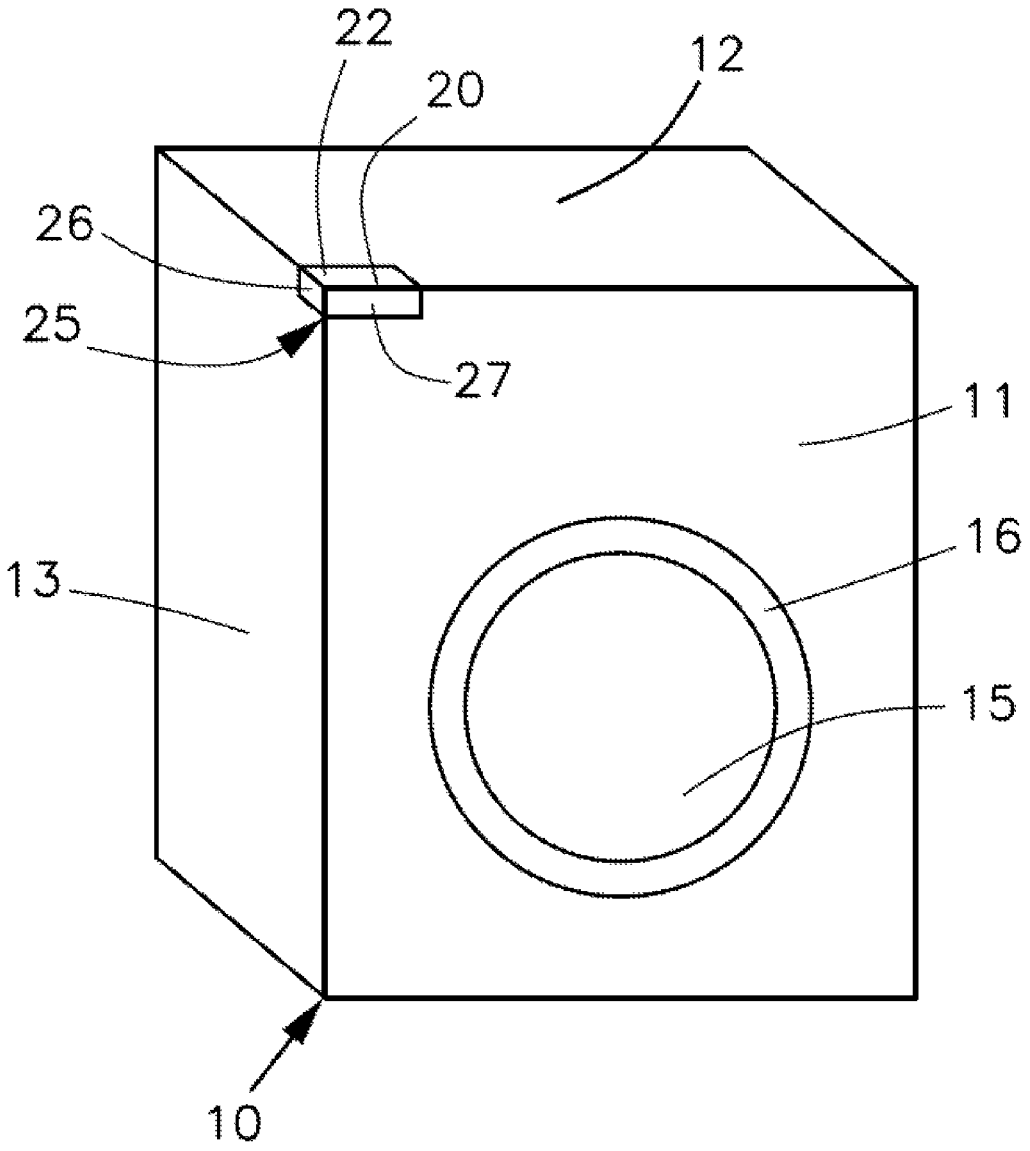
FIG. 1 shows a perspective view of a washing machine with a protective cover of a light emitting element which provides information about the process status of the machine.

FIG. 1 shows a washing and/or drying machine 1 comprising a casing 10 defined by a front panel 11, an upper panel 12, two side panels 13, and a rear panel, said machine having a compartment 15 inside which fabrics are treated, said compartment being accessible through an opening of the casing 10 provided with a door 16.

The washing and/or drying machine 1 also shows a light emitting element 20 (see FIG. 2) arranged inside a cover 25 having portions (27, 22, and 26) integrated in the front panel 11, upper panel 12, and right side panel 13, respectively, and they are flush with the three panels mentioned above.

Figure 2:
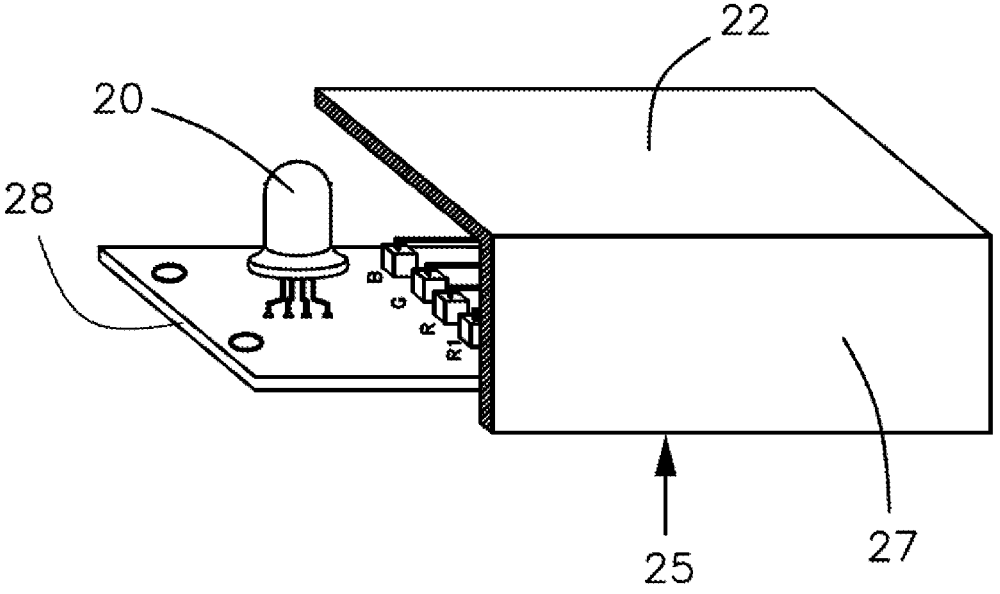
FIG. 2 shows in detail an embodiment of the light emitting element formed by an RGB LED and an electronic control board.

FIG. 2 shows the detail of a light emitting element 20 with the cover 25 partially open, in which the elements making up same, i.e., an electronic control board 28 having connected thereto an RGB LED diode (red, green, and blue) constituting said light emitting element 20, can be seen.

As indicated above, the invention also relates to a control system for controlling a group of washing and/or drying machines for a self-service center, which system comprises:

- at least one light emitting element assigned to each machine;
- an electronic control board configured for regulating the operation of said light emitting element such that it operates according to a color, a color gradation, an intensity, and an intermittency, or a combination thereof, providing coded information in response to an operating status or cycle of said machines;
- one or more imaging devices suitable for capturing said coded information emitted through said light emitting devices; and
- a remote center to which the acquired images are sent for processing and which allows defining work records, machine tracking, and pattern tracking.

In a preferred embodiment, the imaging devices are implemented by means of an electronic vision camera and a control board thereof.

Moreover, said electronic vision camera can adopt a dual functionality of monitoring or watching the self-service center and capturing the operating status of the machines.

It has been envisaged that the system additionally includes one or more displays on which at least one of the images captured by said imaging devices is shown, informing of at least the availability of one of the machines.

The invention claimed is:

1. A washing and/or drying machine for textiles, comprising:

- a casing defining a front panel, an upper panel, two side panels, and a rear panel, and containing a compartment for treating fabrics accessible through an opening of the casing provided with a door;
- a light emitting element arranged inside the machine in an upper corner thereof configured to emit a light indicative of an operating status of the machine and protected by a cover transparent or translucent to light integrated to the casing;
- the cover has a first portion integrated in the upper panel of the casing, a second portion integrated in one of the side panels of the casing and a third portion integrated in the front panel of the casing, and
- the light emitting element is configured to emit light towards an outside of the casing through the front panel, the upper panel and one of the side panels of the casing, the emitted light being visible through the third portion of the cover by a user facing the front panel, through the second portion of the cover by a user facing the lateral panel including the second portion of the cover, and through the first portion of the cover by a user taller than the than the machine placed at any position around the machine.

2. The washing and/or drying machine according to claim 1, wherein said cover is a single element with three delimiting surfaces allowing a passage of light, said delimiting surfaces being flush with the front panel, the upper panel, and the side panel.

3. The washing and/or drying machine according to claim 1, wherein the light emitting element includes at least one light emitting element connected to an electronic control board and arranged facing all portions of the cover.

4. The washing and/or drying machine according to claim 3, wherein the light emitting element provides, in cooperation with the electronic control board, a color gradation with selectable color intensity and/or intermittencies, or a combination thereof, indicative of different operating phases and/or statuses of the machine in a washing or drying cycle.

5. The washing and/or drying machine according to claim 4, wherein said at least one light emitting element is an RGB LED diode connected to an electronic control board.

6. The washing and/or drying machine according to claim 1 wherein the upper corner of the casing is defined in the region where the front panel, the top panel and one of the side panels converge, the front panel including the opening provided with the door.

* * * * *